US008523011B2

(12) United States Patent
Haas et al.

(10) Patent No.: US 8,523,011 B2
(45) Date of Patent: Sep. 3, 2013

(54) REFILLABLE SINGLE-HAND DISPENSER FOR TABLETS

(76) Inventors: Eduard Haas, Balzers (LI); Otto Ziegler, Schaan (LI)

( * ) Notice: Subject to any disclaimer, the term of this patent is extended or adjusted under 35 U.S.C. 154(b) by 844 days.

(21) Appl. No.: 12/520,164

(22) PCT Filed: Dec. 19, 2007

(86) PCT No.: PCT/CH2007/000641
§ 371 (c)(1),
(2), (4) Date: Jun. 19, 2009

(87) PCT Pub. No.: WO2008/074177
PCT Pub. Date: Jun. 26, 2008

(65) Prior Publication Data

US 2010/0084419 A1 Apr. 8, 2010

(30) Foreign Application Priority Data

Dec. 19, 2006 (CH) ..... 2073/06

(51) Int. Cl.
*B65H 1/08* (2006.01)

(52) U.S. Cl.
USPC ..... 221/229; 221/271; 221/232; 221/269; 221/268; 221/270; 221/198; 221/1; 221/281; 221/4; 206/42

(58) Field of Classification Search
USPC ..... 221/229, 198, 271, 232, 269, 268, 221/270, 1, 281, 4; 206/42
See application file for complete search history.

(56) References Cited

U.S. PATENT DOCUMENTS

| | | | | | |
|---|---|---|---|---|---|
| 2,620,061 | A | * | 12/1952 | Uxa | 221/229 |
| 2,833,442 | A | * | 5/1958 | Larsen | 312/71 |
| 3,410,455 | A | * | 11/1968 | Haas | 221/229 |
| 3,511,409 | A | * | 5/1970 | Huck | 221/7 |
| 3,515,111 | A | * | 6/1970 | Auge | 124/16 |
| 3,612,348 | A | * | 10/1971 | Thomas | 221/2 |
| 3,648,831 | A | * | 3/1972 | Arnone | 206/468 |
| 3,688,945 | A | * | 9/1972 | Harman, Jr. et al. | 221/8 |
| 3,854,625 | A | * | 12/1974 | Kuebler | 221/198 |
| 4,142,863 | A | * | 3/1979 | Covington et al. | 422/63 |

(Continued)

FOREIGN PATENT DOCUMENTS

| | | |
|---|---|---|
| CH | 278812 | 10/1951 |
| CH | 478 699 | 9/1969 |

(Continued)

*Primary Examiner* — Gene O. Crawford
*Assistant Examiner* — Rakesh Kumar
(74) *Attorney, Agent, or Firm* — Morriss O'Bryant Compagni, PC

(57) ABSTRACT

The present invention relates to a dispenser, particularly a refillable single-hand dispenser, having a sleeve (13) comprising an opening (23) at the top thereof, and a base part (27) opposite the top. A receptacle (15) for receiving tablets (22), lozenges, or the like is accommodated in the sleeve (3) such that it can be displace in the longitudinal direction. The receptacle (15) can be pulled out of the sleeve (15), the base being biased in the direction of the receptacle top by a zigzag spring (19). The zigzag spring (19) passes through the receptacle (15) through an opening in the base and is supported at the base (27) of the sleeve (13). A tablet package (20) comprising a tubular packaging (65) is disposed in the receptacle (15). The package wall (65) encloses the tablets (22). The sliding base (21) has exterior dimensions that correspond at most to the interior dimensions of the tubular packaging (65).

10 Claims, 5 Drawing Sheets

(56) References Cited

U.S. PATENT DOCUMENTS

| | | | | | |
|---|---|---|---|---|---|
| 4,295,579 | A | * | 10/1981 | Haas | 221/229 |
| 4,749,106 | A | * | 6/1988 | von Schuckmann et al. | 222/96 |
| 5,048,720 | A | * | 9/1991 | Hoke | 221/198 |
| 5,230,440 | A | * | 7/1993 | Kurokawa | 221/7 |
| 5,785,206 | A | * | 7/1998 | Chan | 221/271 |
| 7,533,483 | B1 | * | 5/2009 | Alzamora et al. | 42/50 |
| 2010/0102002 | A1 | * | 4/2010 | O'Brien et al. | 210/668 |

FOREIGN PATENT DOCUMENTS

| | | |
|---|---|---|
| CH | 487 044 | 3/1970 |
| DE | 17 69 082 | 6/1958 |
| EP | 1 292 512 A | 8/2004 |

* cited by examiner

REFILLABLE SINGLE-HAND DISPENSER FOR TABLETS

CROSS-REFERENCE TO RELATED APPLICATIONS

This application claims priority to PCT/CH2007/000641 filed on Dec. 19, 2007, and CH 2073/06 filed on Dec. 19, 2006, the entirety of each of which are incorporated by this reference.

FIELD OF THE INVENTION

The present invention relates to a dispenser, in particular a refillable single-hand dispenser for tablets.

STATE OF THE ART

A dispenser for candy disclosed in EP-A-1 292 512 contains a magazine for the receiving and individual dispensing of tablets with an essentially square case open on the longitudinal side which accepts a longitudinally fed sliding base and a coiled spring supported between the sliding base and a case base. A dispensing apparatus is provided on a case top opposite the case base. On the base side, the magazine is inserted up to the case top in a sleeve, which serves as a supply container and dispenser for refreshment tablets and lozenges which have a stackable basic form.

The tablets are placed in a stack through an open narrow side into the magazine case between the case top and the sliding base. Due to the pressure from the spring over the sliding base, the tablet stack is pressed against the case top and in the dispensing direction. Operating the dispensing device then pushes the upper tablet from the stack oblique to the direction of the stack out of the case, for removal.

The coiled spring engages with its base-side winding end in a clamping slot in the base area of the case. This prevents the spring from jumping out of the case in the event of improper operation of the magazine or if the sleeve is damaged or broken.

The fill the dispenser, the magazine must be withdrawn from the sleeve against the spring force of the coiled spring and the magazine filled with candy. To do this, the tablets packaging must be completely removed, which is not optimum from a hygienic perspective.

A pocket tablet container provided with a tilting lid is known from CH 278812. In a container shell of this pocket container the tablets are placed on top of each other prestressed with a spring. The upper tablet is held by a stop provided at the upper end of the container shell. The tilting lid has a feed element which presses laterally against the upper tablet when the tilting lid is opened, thus pushing it over the edge of the container shell oblique to the container axis. The container shell is designed in two layers. An outer sleeve is provided with a base. An inner sleeve forms a magazine for the tablets and carries the tilting lid. The inner sleeve can be pulled out of the outer sleeve together with the tilting lid in a telescoping fashion.

A spring is under pressure between a pressure part in tablet size, which is provided below the tablet stack, and the base. It presses the tablet stack against the stop. To fill the pocket container, the inner sleeve can be pulled out axially from the upper sleeve, whereby the distance between stop and base increases thereby decreasing the tension on the spring. The inner sleeve is open on a narrow side. By opening, tablets may now be placed into the inner sleeve. Then by inserting the inner sleeve into the outer sleeve, the spring is tensioned.

Anyone who has refilled such a dispenser knows that it is very difficult to maintain the drawer in the tensioned or untensioned open position while filling tablets. It is virtually unavoidable to touch individual tablets. The fact that the candy has to be filed on the narrow side of the withdrawn magazine makes refilling even more difficult.

The present invention provides a dispenser which avoids the disadvantages indicated above. It is particularly an advantage to provide a dispenser which is easy to fill. It would be another advantage to provide a dispenser which can be manufactured at low cost. It would be a further advantage to provide a dispenser which eliminates the risk of the spring jumping out. Yet another advantage would be to provide a dispenser which is flawless in terms of child safety. Yet another advantage is to propose a dispenser, a tablet package and a process which make it possible when filling the dispenser to leave the tablets as much as possible in a packed state so as to avoid direct contact, thus also meeting strict hygiene requirements. On the other hand, an advantage is to have as little packaging as possible in order to avoid needless trash.

SUMMARY OF THE INVENTION

A dispenser according to the present invention is provided with a sliding base with so much play in the magazine that there is room between the sliding base and the magazine for a tablet packaging. This has the advantage that the tablets can be placed in the magazine in a banderole-like packaging tube, in which they can be pushed through the packaging tube and out of the packaging tube.

The cross-section dimensions of the sliding base in the magazine correspond roughly to the interior measurements of the magazine minus at least the double thickness of the packaging wall.

In other words, the invention relates to a dispenser or more precisely, a single-hand with a sleeve, which on the top side has an opening and the opening is opposite a base. This sleeve is provided with a magazine for tablets, which can be removed from the sleeve. A sliding base is received by the magazine by sliding. A spring device received by the magazine engages the sliding base. This dispenser solves the task by being provided with a tubular tablet packaging which can be placed in or received by the magazine and whose sliding base has outer dimensions which at most correspond to the interior dimensions of the tubular tablet packaging.

Since the magazine is provided with an opening on the base side and the spring means is supported on the base of the sleeve by the base side opening, the magazine is not prestressed when it is pulled out of the sleeve. This has the advantage that the magazine can be filled without running the risk of the magazine snapping back into the sleeve.

Advantageously, the sleeve and the base are two pieces. This has the great advantage that the spring means can be placed from the base into the sleeve and/or into the magazine. That creates the possibility to largely automate production. Advantageously, a clamping or latching device is provided on the base side of the sleeve and on the base part. This makes it possible to connect the base part and sleeve by interlocking insertion. The latch means can be designed in such a way as to make it impossible to destroy the base part through retraction.

The above is especially important if the dispenser is to be given to children. The latching means can be created by interacting latches and undercuts which are provided on the base part and the sleeve. However, the person versed in the art is aware of other kinds of snap connectors and welds which permit a permanent connection between base part and sleeve.

The spring means is a zigzag spring. A zigzag spring has a suitable characteristic curve across the desired area. Advantageously, the length and spring characteristics of the zigzag spring are selected in such a way that the sliding base lies in the area of the magazine top in the relaxed state of the zigzag spring. This makes it possible for all tablets in the magazine to stop. Basically, the spring can also be a coiled spring, whose cross-section is round or oval. An oval cross-section has the advantage that the coiled spring can press against the magazine or rather on the wall of packings placed in the magazine, so that the spring force is always applied to the longitudinal direction of the magazine. The zigzag spring however has the advantage that it does not cause a contortion of the sliding base.

According to a particular embodiment, a broad side of the magazine is used as a filling opening for the tablet or lozenge package. The tablets can be filled far more easily through the broadside of the magazine as through the narrow side. In the known state of the art, filling through the broadside is not possible because a guide slot ran virtually along the entire length of the magazine on the magazine's narrow side. The closed broadside lent the magazine the necessary rigidity. Filling from the broadside is disadvantageous is the fact that the dispensing opening formed on the narrow side cannot be part of the filling opening. For that reason, the mold for the magazine is more complex than if the filling opening and the dispensing opening were in the same direction. All the same, the disadvantages in manufacturing clear are outweighed by the advantages for the user.

Advantageously, the side of the magazine opposite the filling opening has one or more openings. It is easy to press the packaging remaining in the magazine through these openings with one finger. If the filling opening is provided on a broadside, even small lozenges are large enough to be pushed through the packaging with one finger.

The sliding base is advantageously designed as a cuboid with an opening in the base. The opening forms a cavity in which the top end of the coil or zigzag spring can engage. Preferably, the sliding base has a cone-shaped top end. The cone-shaped top end can be used to engage in a depression of the tablets stacked in the magazine. This can result in a guiding of the sliding base by the tablets. However, the main purpose of the tapered edges of the cone-shaped top end are to enable introduction of the sliding base into the packaging tube of the tablet packaging without resistance.

According to another independent aspect of the invention, a broad side of the magazine is provided as a filling opening. The use of a broadside as filling opening has the advantage of making the magazine much easier to fill than if the filling is done on the narrow side. Additional advantageous embodiments of such a dispenser have already been described above.

Another aspect of the invention relates to a process for the individual dispensing of stacked tablets of lozenges from a dispenser. In this process, the tablets, which are received in a stack in a magazine of the dispenser, are prestressed using a spring means acting in the longitudinal direction of the magazine. When a dispensing device is operated, a single tablet is dispensed oblique to the longitudinal direction of the magazine. The process is characterized in that the tablets which are received in a banderole-like packaging which is open on the opposite front side of the stack, are inserted with it into the magazine, and that the spring means engages on the end of the inserted stack opposite the dispensing position and dispenses the tablets from the packaging in the direction of the dispensing position. This process has the great advantage of being able to insert the tablets with packaging into the magazine without having to touch them. Advantageously, the tablets prior to placement in the magazine are wrapped in the banderole-like packaging with low play. This makes it easier to dispense the tablets from the packaging. Advantageously, for the tablets such packaging is used whose front can be removed from the packaging before inserting the tablet packaging in the magazine. This can, for example, be cone by providing perforations. The packaging can also be provided with a second coat closing the openings of the tube. The ends of the tube can also be closed with a removable lid, which latch in the tube or on the tube.

The invention also relates to a tablet packaging with a stack of tablets in a packaging tube with openings on both of its ends. The openings with provided with a removable closure of the openings. Such a tablet packaging is suited to be inserted into an inventive single-handed dispenser and thus to be filled or refilled with tablets.

In order to be able to sell the tube as a refill pack, the openings must be closed and the closures must be removable on both ends. This can be achieved by placing a sleeve around the tube. A perforation can also be present on the end of the tube, along which the openings can be torn open, The openings can also be closed with a lid. The packaging tube can be made of paper or cardboard, or also of plastic. Both of these are suited for packaging in a sleeve. This sleeve can be wound around perforated opening closures or around a lid. It can however also directly close the openings, thereby being its own closure for the openings.

The packaging tube can also be provided with a longitudinal continuous slot on a broadside, so that it forms a C-shape when viewed in cross-section. This slot makes it possible to guide the sliding base in the slot and/or through the slot to the sleeve. This has the advantage of reduced canting risk when sliding the sliding base inside the packaging tube. Such a C-shaped tube requires, for example, a thick and easily removable sleeve around the tube which also advantageously closes slot and the ends.

When inserting, the packaging can be opened on one end and be inserted with the opened end facing the sliding base. The sleeve closing the ends of the packaging tube or a lid on the other end can now be removed, while the packaging tube is inserted wholly or partially into the magazine. This prevents the tablets from loosening the packaging while they are being inserted and being lost or having to be touched.

BRIEF DESCRIPTION OF THE DRAWINGS

The invention is described in detail below using figures in an embodiment. The same numbers are used for the same parts in the various figures. It shows.

DETAILED DESCRIPTION OF THE ILLUSTRATED EMBODIMENT

Figure 1:
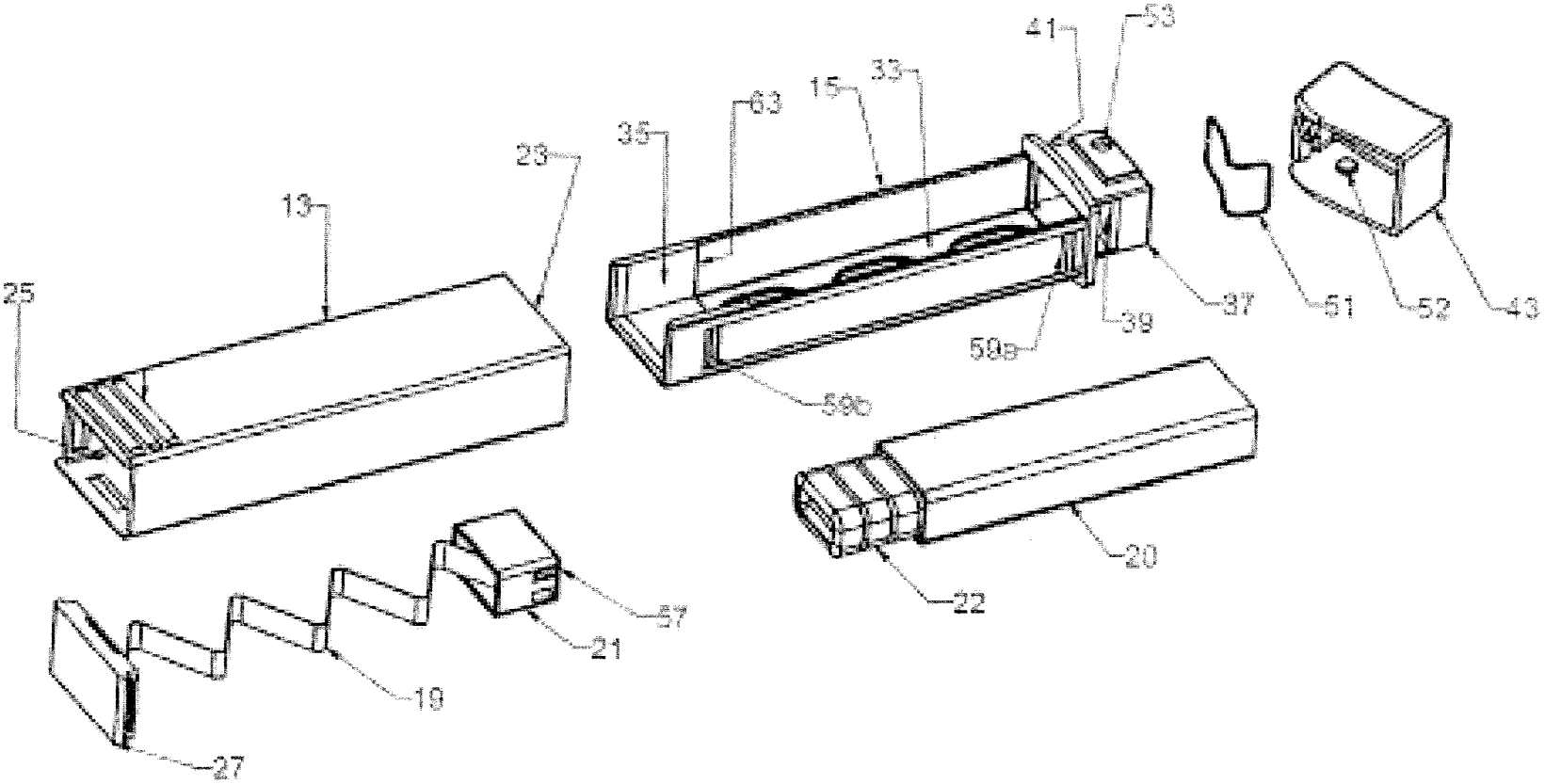
FIG. 1 is an exploded summary of the individual parts of the inventive dispenser with a tablet stack in a banderole-like packaging.
Figure 2:
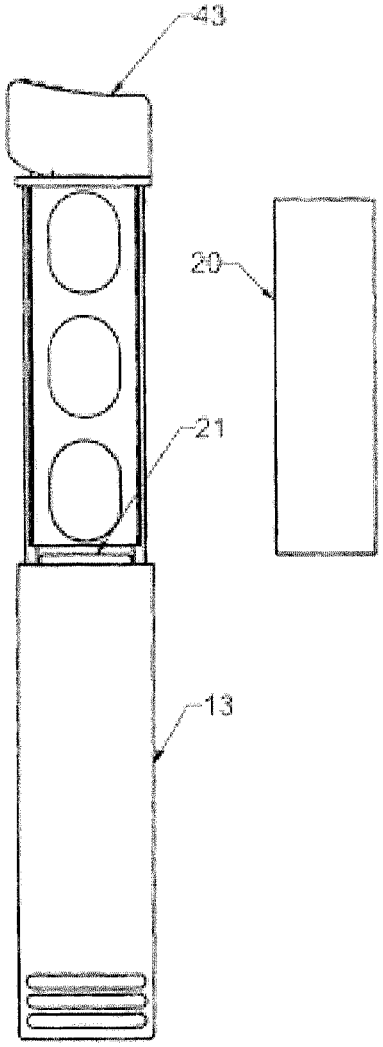
FIG. 2 is a top view of the tablet stack and the dispenser in which the magazine is removed to be refilled.
Figure 5:
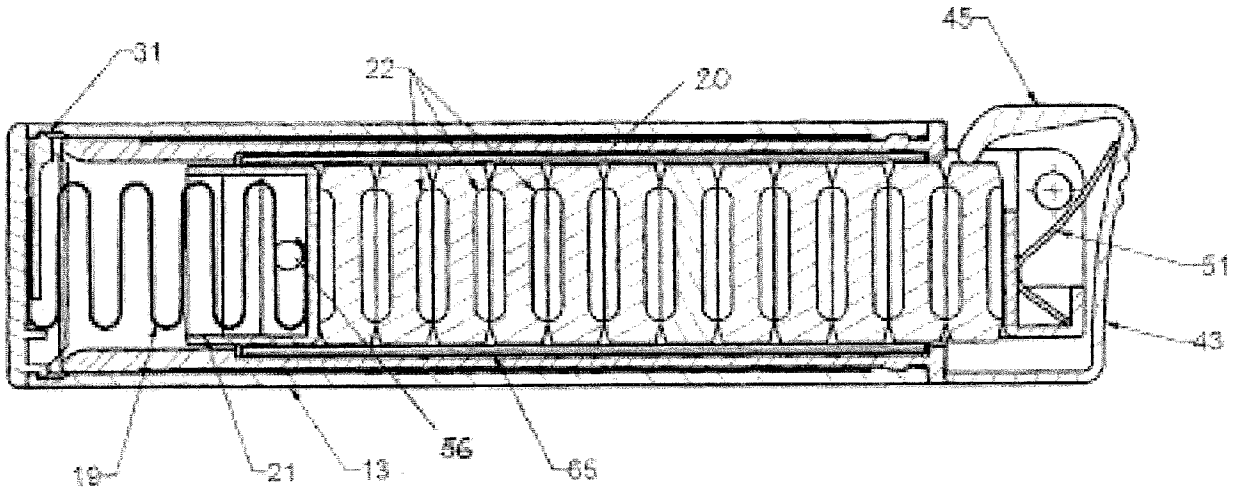
FIG. 5 is a longitudinal section of the filled dispenser.
Figure 5A:
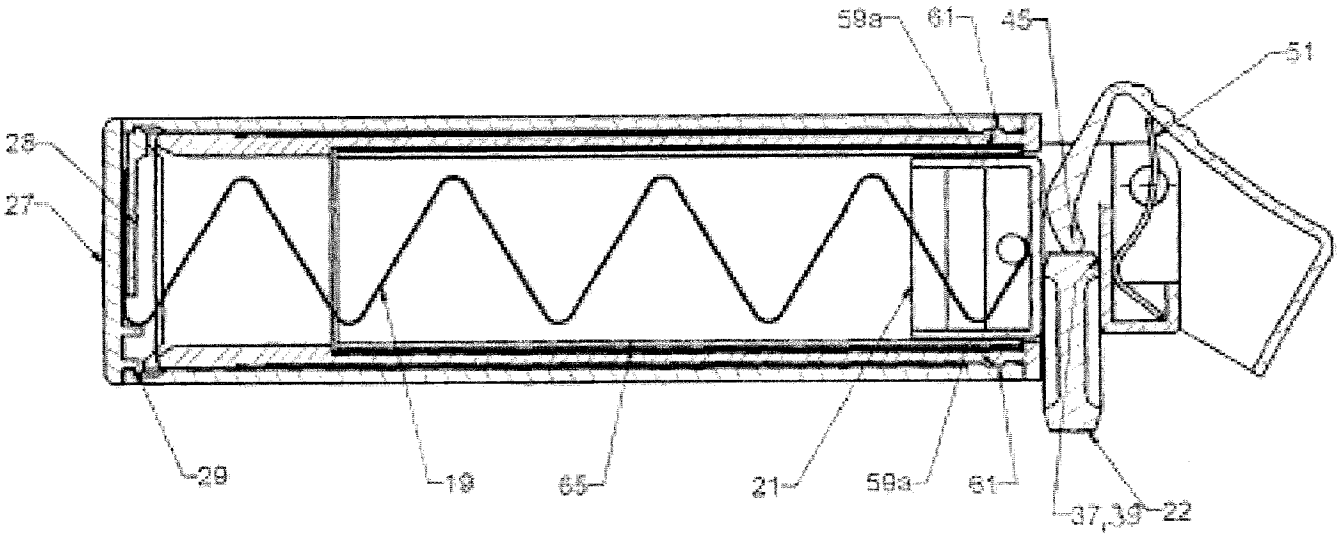
FIG. 5A is a longitudinal section according to FIG. 5, but during the dispensing of the last tablet.
Figure 10:
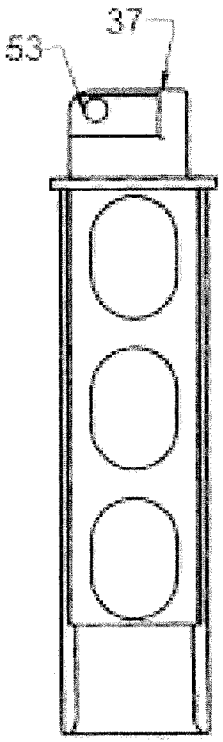
FIG. 8 through 10 are a bottom view, a side view and a top view of the magazine.
Figure 9:
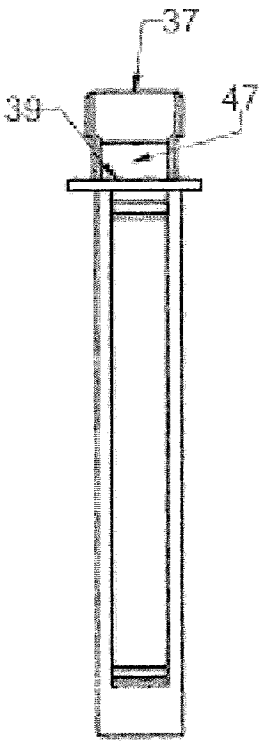
Figure 8:
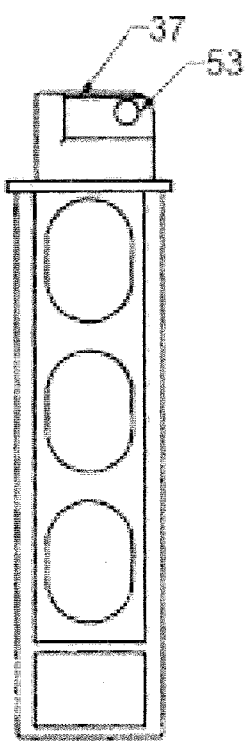
Figure 6:
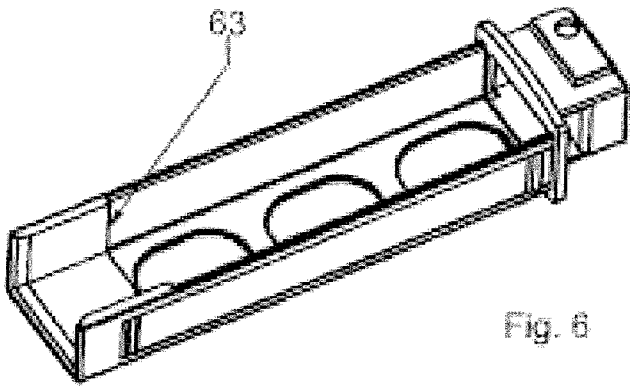
FIG. 6 and FIG. 7 are two different perspective views of the magazine.
Figure 7:
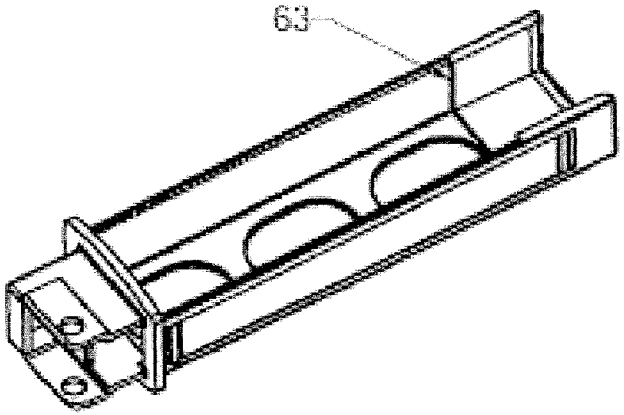
Figure 11:
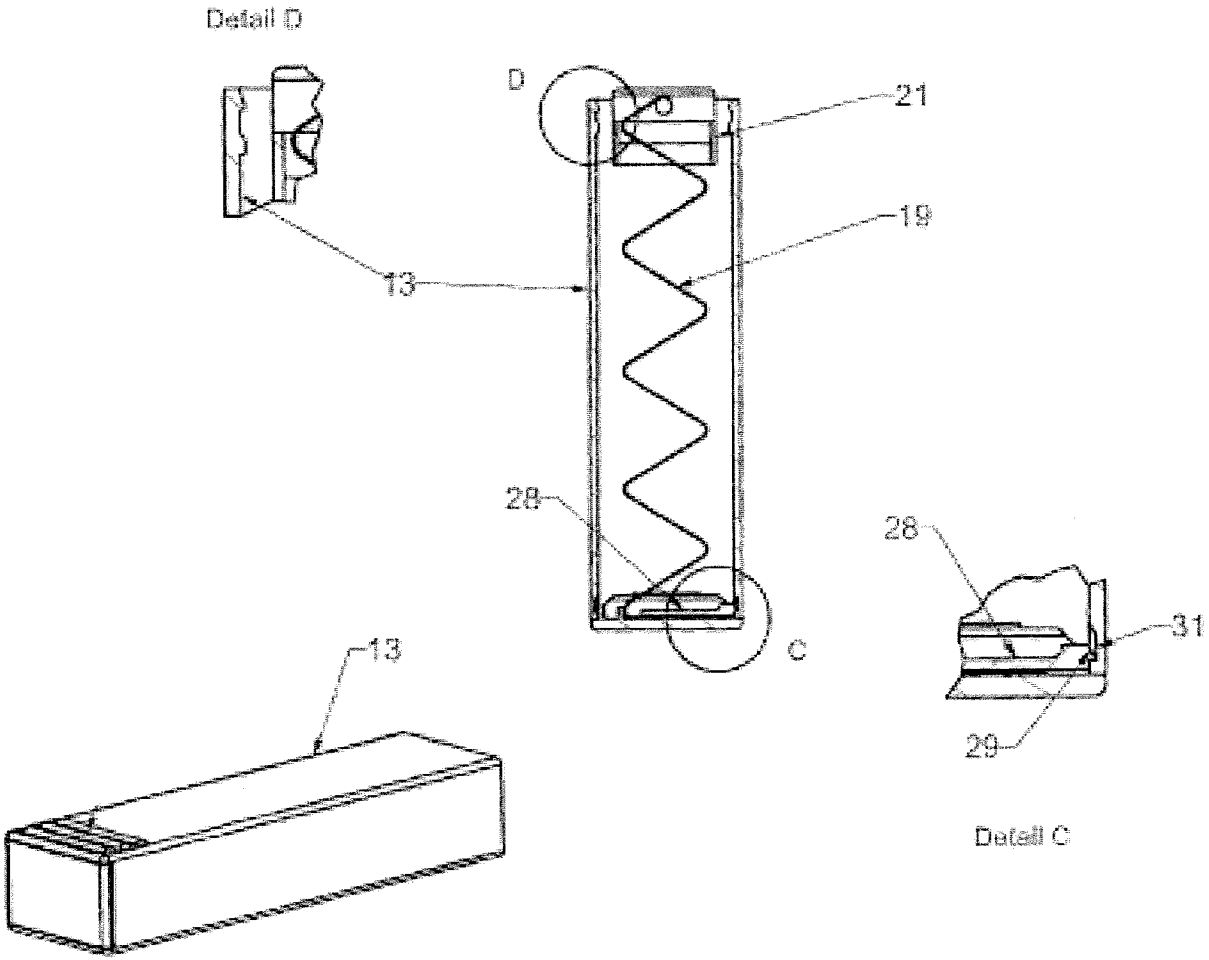
FIG. 11 is a partial perspective sectional view of the sleeve of the dispenser with detailed views of the base and top areas.

The figures show the inventive dispenser, whose important components are a sleeve 13, a magazine 15 received in the sleeve from which it can be removed, and a zigzag spring 19 which works in conjunction with a movable sliding base 21. FIGS. 1, 2 and 5 also show a tablet packaging 20 with a plurality of stackable tablets 22, which tablet packaging can be received by magazine 15. The sleeve 13 is designed as a cuboid longitudinal case with a top opening 23 and a based opening 25 (FIG. 1). The base opening 25 is closable using a base part 27. The base part 27 has one or more rails 28 (FIGS. 5A and 11) on its interior, which, as described below, stop the base-side end of the zigzag spring 19. A latching device is provided interlocking on the base part 27 and in the interior of sleeve 13. This latching device, as shown in the embodiments, comprises a latch 29 and an undercut 31 formed around the sleeve (see detailed view, FIG. 11).

The magazine 15 is also cuboid in shape, in which however a broadside and the base side are omitted. While the open broadside of the magazine serves as filling opening 33 for the tablet packaging, the base-side magazine opening 35 provides access to zigzag spring 19, as will be described below in greater detail.

Figures 3, 4:
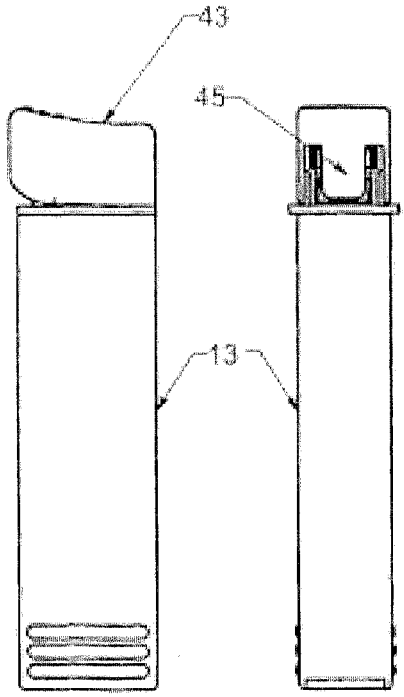
FIG. 3 is a top view of the dispenser with a closed magazine.
FIG. 4 is a side view of the dispenser.

The magazine 15 is provided with a magazine top 37 (FIGS. 1, 8 through 10), which protrudes from the sleeve 13 in the magazine 15 inserted in the sleeve 13 (FIGS. 3 and 4). The head wall of the cuboid magazine 15 forms a stop front 39, which stops the upper tablet of the dispenser in an operation and filled state. The stop front 39 is situated with an inserted magazine roughly one tablet thickness outside the upper edge of the sleeve 41. The distance between the stop front 39 and the edge 41 of the magazine 15 defines the dispensing position for the uppermost tablet in the magazine.

A swiveling part 43 is hinged on the magazine top 37. The swiveling part 43 has an extension 45 (FIGS. 4, 5, 5A), which can engage in a slot 47 (see FIGS. 5, 9) provided in a narrow side of the magazine top 37. A spring 51 engaged on magazine top 37 provides automatic resetting of the swiveling part 43 to its normal position. The swiveling part engages using two pivots 52 on the inside in corresponding round holes 53 on the magazine top 37 (FIG. 1).

The sliding base 21 is received longitudinally in the magazine 15. The sliding base 21 has a tub-like shape with a cavity which is used to receive the top end of the zigzag spring 19. The top end of the zigzag spring 19 can be latched on a rail 56 (FIG. 56). The top end 57 of the sliding base is preferably provided conically or with rounded corners. The base-side end of the zigzag spring is, as already stated above, is latched in the operating state of the dispenser in the slot between the base part 27 and the rail 28.

Outside on the narrow sides of the magazine 15, there are provided in the top area front and back latches 59*a*, 59*b* and in the foot area only one back latch 59*b* (FIG. 1). Latches 59*a*, 59*b* act together with grooves 61, which are provided opposite each other at a short distance from the top-side edge on the flat interior of sleeve 13 (see detail in FIGS. 5 and 11). In a close state, the latches 59*a* lock in place, and when the magazine is removed the latches 59*b* lock in grooves 61. A snap-on connector guarantees that the magazine remains in the inserted position and cannot slip out of the sleeve, or remains in the open position when filling. Preferably, the latches lock into the grooves with an audible click.

In a particular embodiment of the lock between sleeve 13 and magazine 15 (or vice-versa on sleeve 13), a spring tongue is provided which engages in an interlocking fashion with a latch in the wall of the sleeve 13 (or vice-versa in the wall of magazine 15). By pressing on the flexible tongue (or pulling on the flexible tongue) the latch can be released from the opening in the wall receiving the latch, making the magazine movable. In the relaxed position, the flexible tongue is in contact with the latch in the opening and in the tensioned position it is out of contact. The base part 27, on the other hand, is engaged in the sleeve 13 in such a way or linked to the sleeve that it cannot be detached from this sleeve without being damaged.

Both of these measures have the advantage that they do not unintentionally free the base part from the sleeve, thereby opening the magazine. The spring force of the spring means can therefore only relax in a controlled fashion.

The interior of the base area of the magazine is provided with protruding tracks 63 or stop fronts. The magazine edge 41 protrudes on the interior of the magazine into the interior of the magazine. In FIG. 5, the tubular tablet packaging 20 is inserted between the protruding magazine edge 41 and the stop fronts of the tracks 63. The distance between these tracks 63 and the magazine edge 41 is chosen in such a way that a packaging tube of a tablet stack is received in the magazine 15 with a low amount of play. The tracks 63 and the magazine edge 41 prevent the packaging tube from sliding in the direction of the spring fore of the coil spring 19.

According to a particular embodiment, the distance between the narrow sides of the magazine 15 is such that a tablet stack can be inserted with packaging 20 (see FIG. 5). To remove the tablets, the sliding base 21 presses the tablets 22 from the tubular packaging 20, and the empty packaging remains in the magazine. The packaging can be made of paper, cardboard or plastic. FIG. 5 shows a tablet 22 in the dispensing position. The empty packaging 20 can be removed from the magazine by pushing with the fingers through the openings found in the base of the magazine. The thickness of the walls 65 of the packaging 20 and the dimensions of the magazine and the sliding base are selected in such a way that the packaging 20 fills the magazine in cross-section and the sliding base 21 fits in the tubular packaging. The size difference between the sliding base and the magazine therefore equals at least the double thickness of the walls 65 of the packaging 20.

The inventive dispenser is filled by removing the front packaging parts and placing the tablet stack with the remaining tubular packaging 20 between the tracks 63 and the magazine edge 41 into the withdrawn magazine 15 of the dispenser 11. The magazine is then pushed back into the sleeve 13 against the spring force until the latches 59*a* audible engage in the grooves 61. Using the spring 19 the sliding base presses against the packaging and the tablets 22 are expelled from the packaging along with the sliding base.

By tilting the swiveling part 43, the tablet 22 is pushed out of the magazine by the extension 45 oblique to the stack direction. As soon as the tablet is removed and the swiveling part 43 has returned to its original position, the next tablet is moved into place.

The invention claimed is:

1. A refillable single-hand dispenser, comprising:

a sleeve having a face defining a face opening and a base across from the face opening, a magazine configured to accept at least one of tablets or lozenges that can be removed from the sleeve, said magazine defining a base opening on a base side thereof, a sliding base movably receivable in the magazine, a spring device receivable in the magazine, which on the one side engages the sliding base and on the other side is supported on the sleeve on the base, the sliding base receivable in the magazine with clearance to provide room for a tubular tablet packaging between the sliding base and the magazine, and constructed to be insertable in the tubular tablet packaging by the spring device, wherein cross-section measurements of the sliding base in the magazine roughly correspond to interior measurements of the magazine minus at least a double thickness of a wall of the tubular tablet packaging for the at least one of tablets or lozenges, and a base area of the magazine provided with a plurality of protruding tracks and a magazine edge having a rim, the rim and the plurality of tracks protruding into an interior of the magazine such that an annular space is formed between a side wall of the sliding base and an interior wall of the magazine between the plurality of tracks and the rim.

2. The dispenser according to claim 1, wherein the sleeve and the base are two pieces.

3. The dispenser according to claim 1, further comprising a clamping or latching device provided on a base side of the sleeve and on the base.

4. The dispenser according to claim 2, wherein the clamping or latching device is formed from latches and undercuts, the latches and undercuts provided on the sleeve.

5. The dispenser according to claim 1, wherein a length and spring characteristics of the spring device are configured so that in a relaxed state the sliding base comes to lie proximate the face of the sleeve.

6. The dispenser according to claim 1, wherein the spring device is a zigzag spring.

7. The dispenser according to claim 1, wherein a broad side of the magazine serves as a filling opening for the at least one of tablets or lozenges.

8. The dispenser according to claim 7, wherein an opposite side of the magazine of the filling opening comprises one or more openings.

9. The dispenser according to claim 1, wherein the sliding base is a cuboid with an opening on a base side thereof.

10. The dispenser according to claim 1, wherein cross-sections of the sleeve and magazine are rectangular.

* * * * *